United States Patent [19]

Stol

[11] Patent Number: 4,560,086

[45] Date of Patent: Dec. 24, 1985

[54] HELICAL ELEVATING DISPENSER FOR ROUND OBJECTS SUCH AS CANDIES

[76] Inventor: Israel Stol, 639 Rocksprings Rd., Pittsburgh, Pa. 15228

[21] Appl. No.: 534,364

[22] Filed: Sep. 21, 1983

[51] Int. Cl.[4] ..... B65D 83/04

[52] U.S. Cl. ..... 221/24; 198/724; 198/778; 221/75; 221/192

[58] Field of Search ..... 221/75, 24, 192, 228, 221/229; 198/778, 724, 658, 676, 659, 663, 670, 688

[56] References Cited

U.S. PATENT DOCUMENTS

| | | | |
|---|---|---|---|
| 2,606,088 | 8/1952 | Leaf . | |
| 2,628,708 | 2/1953 | Wahl et al. | 198/724 |
| 2,855,124 | 10/1958 | Gensmer | 221/24 |
| 3,189,221 | 6/1965 | Lachance . | |
| 3,273,748 | 9/1966 | DeShon | 221/75 |
| 3,572,548 | 3/1971 | Fuchs | 221/225 |
| 3,706,394 | 12/1972 | Merz | 221/75 |
| 3,715,055 | 2/1973 | Kendrick | 221/75 |
| 3,833,110 | 9/1974 | Riggs | 198/676 X |
| 4,360,204 | 11/1982 | Karr | 273/201 |

*Primary Examiner*—F. J. Bartuska

*Attorney, Agent, or Firm*—Cushman, Darby & Cushman

[57] ABSTRACT

A dispenser is provided which includes a generally upright body having an external helical groove journalled for rotation in a preferably transparent outer sleeve. Resilient fingers in the groove or on the inside of the sleeve project into the groove space. An outlet is provided near the top of the dispenser. As the body is rotated, preferably manually, relative to the sleeve in one angular sense, small, firm round objects located in the groove are urged along the groove and serially expelled from the dispenser at the outlet. The dispenser regionally of the outlet may be shaped to resemble a cartoon character or the like. In a preferred embodiment the outlet does not rotate relative to the grooved body so there is no danger that a child can hurt its finger by sticking it into the outlet while the dispenser is being operated. The device is useful in teaching a small child the art of twisting one object relative to another, pepper grinder-fashion.

8 Claims, 7 Drawing Figures

HELICAL ELEVATING DISPENSER FOR ROUND OBJECTS SUCH AS CANDIES

BACKGROUND OF THE INVENTION

Various items of equipment are available in the prior art for serially dispensing on demand small, firm, round objects, such as gum balls, jaw breakers, other hard candies and marbles. Often these devices are designed to be operated only upon the insertion of a coin, check or token, whereupon an actuating lever is indexed, slid and released, or the like.

SUMMARY OF THE INVENTION

A dispenser is provided which includes a generally upright body having an external helical groove journalled for rotation in a preferably transparent outer sleeve. Resilient fingers in the groove or on the inside of the sleeve project into the groove space. An outlet is provided near the top of the dispenser. As the body is rotated, preferably manually, relative to the sleeve in one angular sense, small, firm round objects located in the groove are urged along the groove and serially expelled from the dispenser at the outlet. The dispenser regionally of the outlet may be shaped to resemble a cartoon character or the like. In a preferred embodiment the outlet does not rotate relative to the grooved body so there is no danger that a child can hurt its finger by sticking it into the outlet while the dispenser is being operated. The device is useful in teaching a small child the art of twisting one object relative to another, pepper grinder-fashion.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION OF THE DRAWINGS

In the Drawings

FIG. 7 is a longitudinal sectional view of another modification.

DETAILED DESCRIPTION

Figure 1:
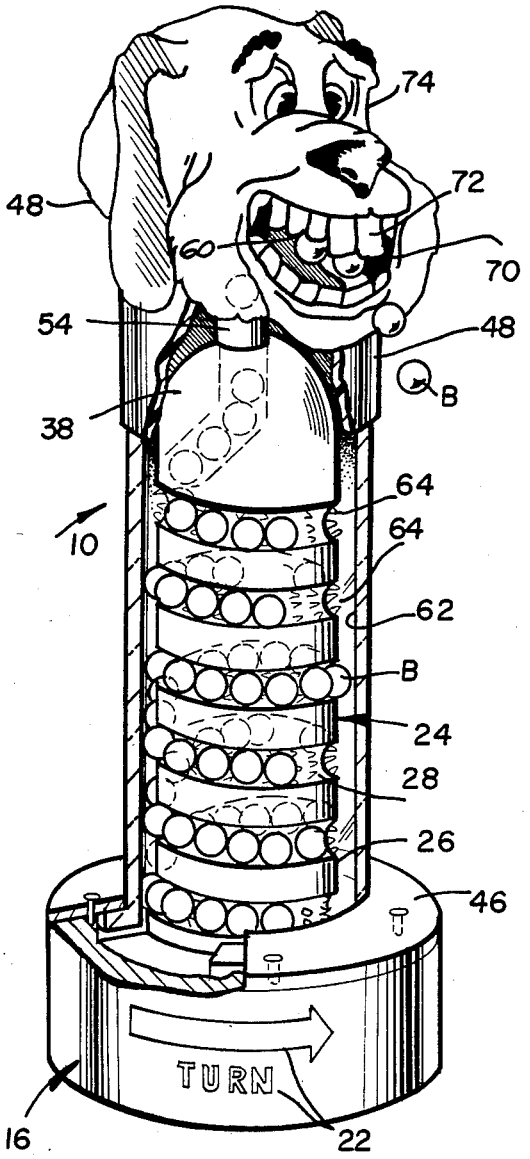
FIG. 1 is a perspective view, with parts broken away and sectioned to show internal detail, of a first embodiment of a dispenser embodying principles of the present invention.
Figure 2:
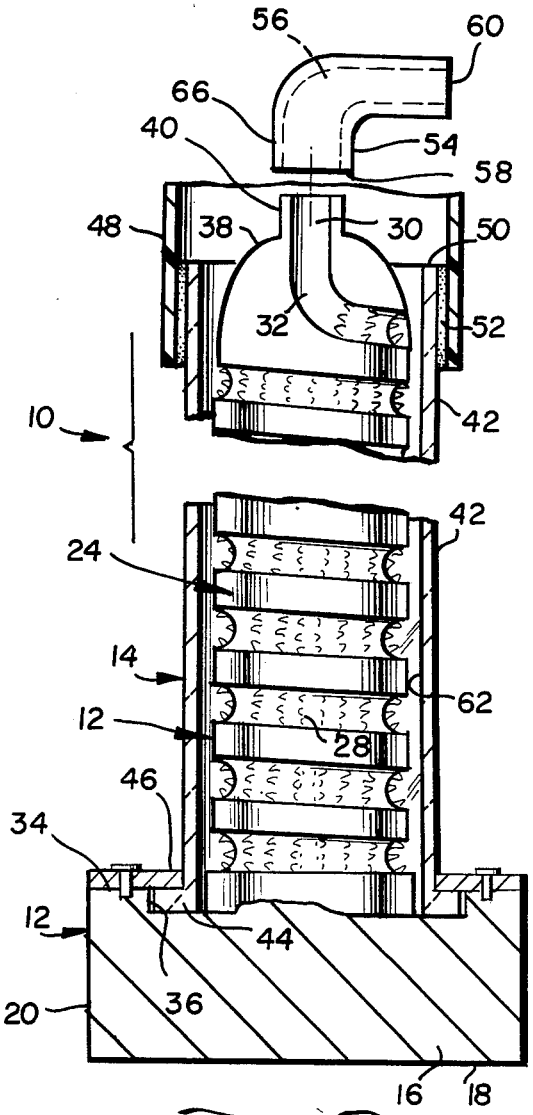
FIG. 2 is a longitudinal sectional view thereof.

A first embodiment of the dispenser of the invention is illustrated at 10 in FIGS. 1 and 2. This dispenser has two main portions, namely a body 12 and a sleeve 14.

The body 12 is shown including a base 16 having a bottom 18 on which the body may rest in an upright condition. In this embodiment, the body base sidewall 20 may be provided with indicia 22 indicating the direction in which the base should be rotated relative to the sleeve 14 in order to dispense small, firm, round objects B serially from the top of the dispenser 10. The body 12 is shown further including a cylindrical tower 24 centrally mounted in an upright condition on the base 16. The tower 24 and base 16 may be integrally formed, or separately formed and assembled together in any convenient manner. Polystyrene plastic is one material of which the body 12 may be made, e.g. by molding. The tower 24 outer peripheral sidewall 26 is shown externally provided with a helical groove 28 of multiple turns. As shown, the groove 28 begins at or near the base 16 and ends in an outlet 30 which may include a short segment 32 which tunnels obliquely upwardly through the tower 24, e.g. so as to curve up and emerge axially centrally. (The tunneling concept is optional; the groove 28 may alternatively proceed on the sidewall 26 to an outlet 30 as is shown in connection with the FIG. 7 embodiment).

The base 16 is shown including an upper end wall 34 circumferentially surrounding the base of the tower 24. This upper end wall 34 is shown concentrically formed with an upwardly-opening annular groove 36. The tower 24 is shown having an upper end 38 which is coaxially centrally provided with a bearing means, here in the form of an upwardly-opening socket 40 of circular transverse cross-sectional shape.

The sleeve 14 includes a tubular main portion 42 which is preferably molded of clear plastic material, e.g. polystyrene. As a mounting and bearing means, the main portion 42 is shown provided on its lower end with a circumferentially extending radially out-turned flange 44. To rotatably mount the sleeve 14 on the base of the body 12, the sleeve is slipped over the tower and coaxially telescoped with the tower until the flange 44 seats in the groove 36. Then an annular locking ring 46 is fastened onto the upper end wall 34 of the base, partially obstructing the mouth of the groove 36, i.e. sufficiently to overlie the flange 44 and thus lock the sleeve 14 against axial movement while leaving the sleeve 14 able to be rotated.

The assembly shown is completed by slipping a head 48 onto the upper end 50 of tubular main portion 42 of the sleeve 14 and securing it in place, e.g. by solvent welding at 52. The underside of the head 48 is shown centrally coaxially provided with a complementary bearing means, e.g. a cylindrical boss 54 which, in the act of assembly of the sleeve 14 to the body 12 becomes journalled on the socket 40. The head 48 includes at least one outlet passageway 56 formed generally radially therethrough so as to have an inner end 58 juxtaposed with the outlet 30 of the groove 28 on the tower 24 and an outlet end 60 disposed so as to open or to be easily accessible from the outside of the dispenser 10.

Figure 3:
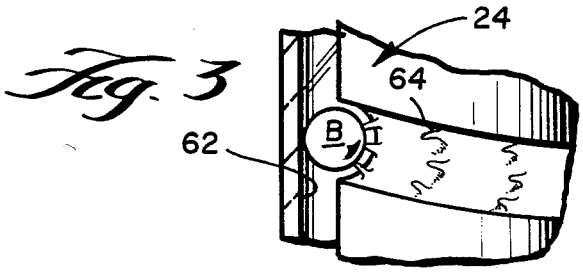
FIG. 3 is an enlarged fragmentary longitudinal sectional view of a detail of the structure shown in FIG. 2.
Figure 4:
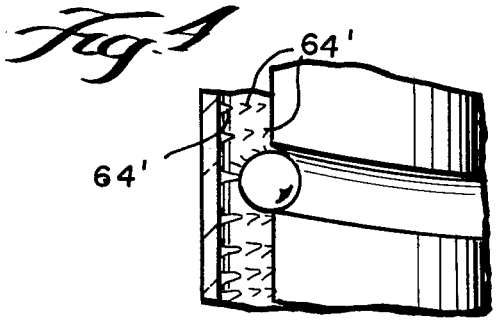
FIG. 4 is a similar longitudinal sectional view of a modification.
Figure 1:
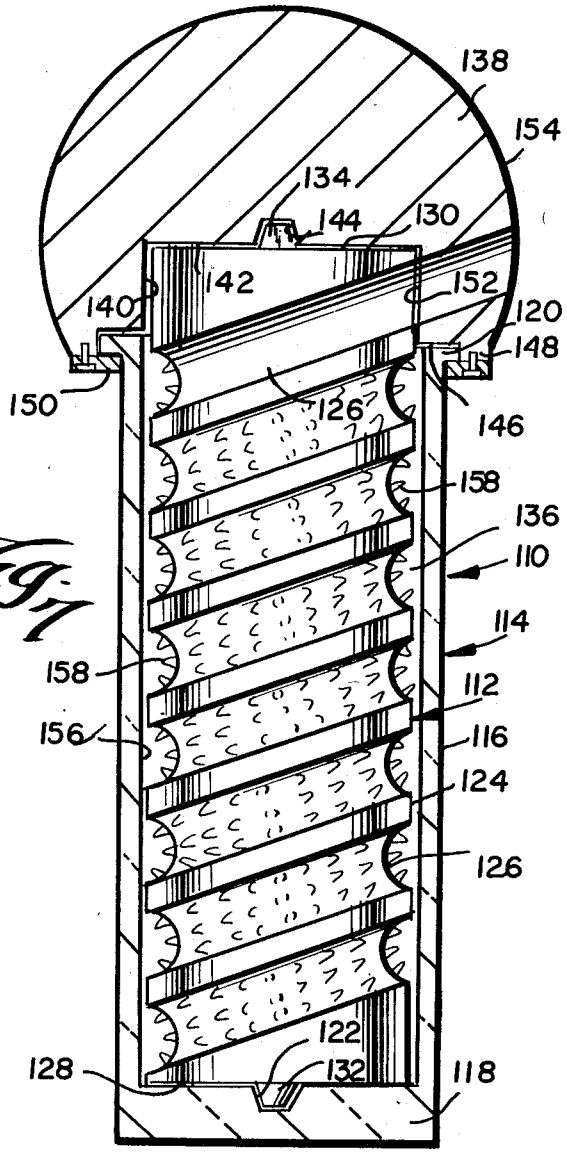

The tower 24 and tubular main portion 42 are so sized, relative to one another that when an object to be dispensed is rooted in the groove 28 it also lightly-engages the inner surface 62 of the sidewall of the tubular main portion 42. If needed to prevent slippage of the objects to be dispensed, and to promote traction thereof, flexible bristles or fingers may be formed in the groove 28 as illustrated at 64 in FIGS. 1–3, and/or on the sidewall surface 62 as illustrated at 64' in FIG. 4.

In FIGS. 1 and 2, the head 48 is shown being externally decorated, e.g. so as to have the shape and appearance of a head of an animal, cartoon character, literary figure, television personality, movie star or the like. In this instance, the head 48 is shown shaped and decorated to look like a dog and the outlet passageway 56 is a ninety degree elbow-type conduit having a coaxially downwardly opening lower end portion 54 comprising the socket 66, telescopically journalled for rotation on the coaxially upwardly opening tubular stub 40 which forms the boss 54. The outlet passageway 56 outlet end 60 opens in the mouth 70, behind the flexible teeth 72 of the dog character 74.

Accordingly, as a person, e.g. a small child, twists the base 16 in the direction of arrow 22, relative to the sleeve 14, e.g. by holding the dispenser 10 upright with two hands and twisting with the hand that holds the base, any objects B such as individual hard candies held in the groove 28 are propelled up along the groove 28 and serially out of the outlet end 60 of the outlet passageway 56. In this instance, each candy may lodge in the mouth 70 behind the flexible teeth 72, whereupon it can be removed by reaching in, grasping the object and pulling it out, an act which is accompanied by temporary flexing of the teeth.

Figure 6:
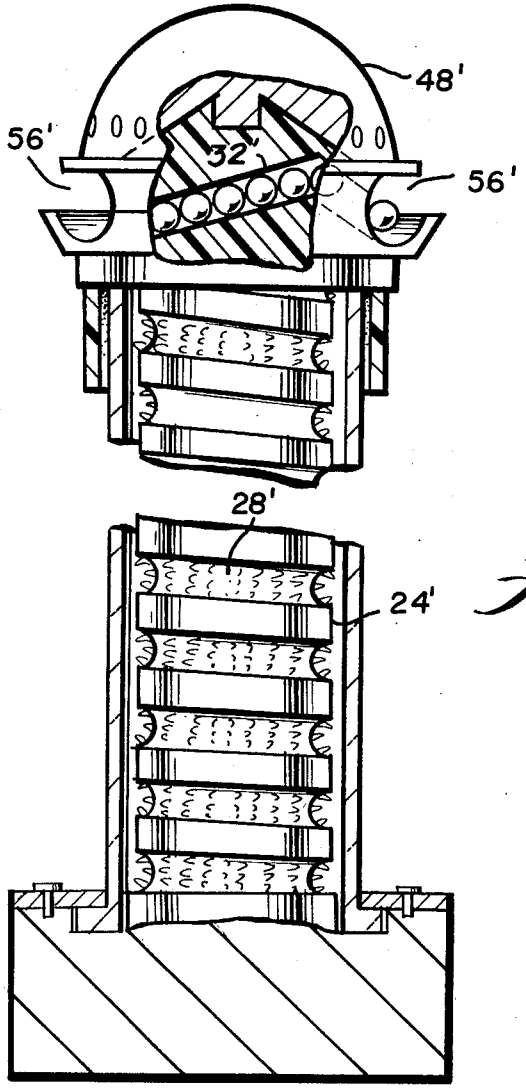
FIG. 6 is a longitudinal sectional view thereof.
Figure 5:
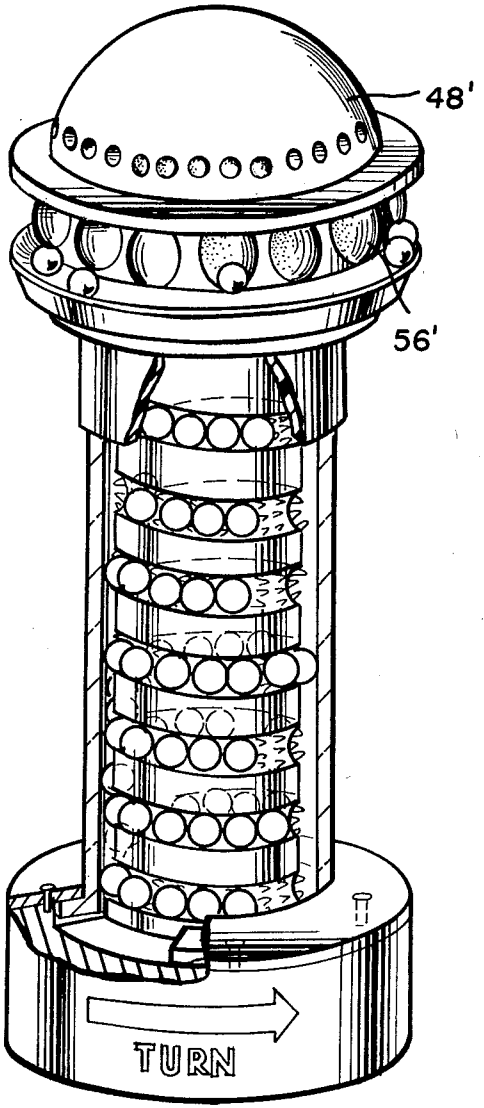
FIG. 5 is a broken away perspective view similar to FIG. 1 of a modified embodiment.

Another embodiment is illustrated in FIGS. 5 and 6. Most parts are the same as in FIGS. 1–4 and are given like numbering, with primes, however, here, the short outlet end segment 32' of the groove 28' tunnels obliquely upwardly through the tower 24' and emerges diametrically across from and somewhat above where it penetrated. In this embodiment the head 48' is shaped like the crown of a monument having several outlet passageways 56' angularly spaced around the circumference of the head 48'. Just below the ring of outlets 56' there is shown formed a trough 70' which is constructed and arranged to catch the expelled objects B. Accordingly, as the sleeve 14' is rotated relative to the body 12', objects B are dispensed serially from successive ones of the outlets 56'.

The specific FIGS. 5 and 6 embodiment may have a detractive feature not present in the FIGS. 1–4 embodiment in that a child might hurt its finger if it stuck its finger into one of the outlets 56' sufficiently to encounter the outlet 30' of the groove 28' of the tower 24'. And the specific FIGS. 1–4 embodiment, as shown, may have a detractive feature not present in the FIGS. 5 and 6 embodiment in that perhaps it is not such a good idea to suggest to a child that he or she put his or her fingers into a dog's mouth in order to take away a piece of food. These possibly detractive features are not fundamental to the invention, but only are possible detriments insofar as the specific embodiments illustrated in these Figures. The embodiment shown in FIG. 7, for instance, has neither of those features.

In FIG. 7, the dispenser 110 has a body 112 and a sleeve 114. The sleeve 114 includes a tubular sidewall 116, e.g. of transparent plastic material, and a bottom end wall 118 which provides a base. The upper end of the sleeve is provided with an out-turned circumferential flange 120. The bottom end wall 118 is internally provided with an axially centrally located, upwardly opening socket 122 of circular transverse cross-sectional shape to act as a bearing.

The body 112 is a generally cylindrical member having an outer peripheral sidewall 124 in which the helical groove 126 of several turns is provided, a bottom end wall 128 and an upper end wall 130. A boss 132 of circular transverse cross-sectional shape is shown axially centrally formed externally on the bottom end wall 128 so as to project axially downwards. A boss 134 of non-circular transverse cross-sectional shape is shown axially centrally formed externally on the upper end wall 130 so as to project axially upwards.

The body 112 is assembled to the sleeve 114 by telescoping the body 112 into the cavity 136 of the sleeve and advancing it until the boss 132 becomes journalled for rotation in the socket 122. The body 112 is longer than the cavity of the sleeve 114 by such an extent that the whole upper end of the last turn of the spiral groove 126 lies somewhat above the upper end of the flange 120 on the upper end of the sleeve 114.

In the FIG. 7 embodiment as depicted, the head 138 is a bulbous object having a comparatively large downwardly-opening cavity 140 formed axially centrally in its underside. The end wall 142 of this cavity 140 is shown coaxially formed with a further, comparatively small socket 144 of non-circular transverse cross-sectional shape. The lower end wall 146 of the head 138 is shown coaxially formed at its outer periphery, spacedly surrounding the mouth of the cavity 140 with an axially short tubular flange 148 which is about as long as the flange 120 is thick.

In assembling the dispenser 110, the head is slipped over the projecting upper end of the body 112, and telescoped down into place until the flange 148 circumferentially surrounds the flange 120 to provide an upper bearing means, and the non-circular boss 134 is seated in the non-circular socket 144 so as to provide a driving connection. An annular locking ring 150 is then fastened onto the flange 148 so as to engage under the flange 120 to hold the head 138 fixedly mounted to the body 112 and rotationally mounted to the sleeve 114.

The head 138 includes a generally radially directed passageway having an inner end 152 juxtaposed with the upper end of the spiral groove 126 and an outer end communicated externally of the head 138. The outer surface 154 of the head may be decorated in shape and/or in line in order, e.g. to simulate a cartoon character or the like. As with the prior embodiments, the groove 126 and/or the inner face 156 of the sidewall of the sleeve 114 preferably is formed with radially projecting flexible fingers or bristles 158 for ensuring light frictional contact of the objects B to be dispensed with the groove 126 and the sleeve sidewall. Accordingly, even if there is only one candy or the like in the dispenser of the invention, it can be reliably dispensed without needing to be pushed along by another object B behind it in the groove.

In the embodiment shown in FIG. 7, dispensing is accomplished by grasping the sleeve 114 with one hand and the head 138 of the body 112 with the other and twisting one angularly relative to the other.

The constructions shown in the drawing figures are exemplary. Structures shown as an integral part may be made in pieces and assembled or fabricated together using mechanical connectors, adhesives or the like. Flanges shown trapped in slots by covering, locking rings may be formed as slightly resilient barbed structures which are snapped through slots or into undercut grooves. In lieu of resilient fingers or bristles, a frictional drive surface such as a rubber coating may be provided on the main groove in the tower of the body. What is needed is something to let the rotation of the body drive the objects B up the groove, i.e. in the helix/sleeve clearance, without the possibility that the objects B will get stuck or roll back down before reaching the outlet and emerging.

One way that the dispenser may be loaded is to put the objects B serially in through the outlet while winding relatively backwards. Another way is to build a reservoir into the base (not shown) and tilt or invert the device to induct objects B serially into the lower end of the helical groove.

It should now be apparent that the helical elevating dispenser for round objects such as candies as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A dispenser for small, firm, round objects such as jaw breakers, comprising:

a body including a generally cylindrical tower having an outer peripheral sidewall with means defining a helical groove of a plurality of turns therein, said groove having an outlet located towards an end of said tower;

a sleeve including a tubular portion having said body coaxially rotationally received therein, said sleeve tubular portion having an inner peripheral sidewall which is radially gapped from said groove so as to provide a clearance for receipt of a plurality of said objects serially disposed in the groove, each in frictional contact both with the body, in said groove, and the sleeve, against the inner peripheral sidewall of said tubular portion; and resilient means radially projecting into said groove along the length thereof for preventing roll-back of objects being dispensed, so that as the sleeve is rotated in one angular sense relative to the body, any said objects received in said clearance are advanced serially along said groove to said outlet and as the sleeve is rotated in an opposite angular sense relative to the body, any objects received in said clearance are retracted serially along said groove from said outlet;

said resilient means being constituted by a series of flexible bristles mounted on at least one of the outer peripheral sidewall of said tower and said inner peripheral sidewall of said tubular portion of said sleeve.

2. The dispenser of claim 1, wherein:

said tubular portion of said sleeve is made of clear plastic material, so that the user may observe the location and progress of said objects as the dispenser is being operated.

3. The dispenser of claim 1, wherein:

one of said body and said sleeve further includes a head mounted thereto in capping relation to said tower;

said head including an outlet passageway formed therethrough, said outlet passageway having an inner end juxtaposed for receiving said objects as said objects serially emerge from said outlet of said groove, and having an outer end opening to externally of the dispenser.

4. The dispenser of claim 3, wherein:

said head is shaped and decorated to resemble an animal head and said outlet passageway emerges from what appears to be a mouth of said animal head.

5. The dispenser of claim 4, wherein:

said head further includes a plurality of flexible teeth partially obstructing said outlet passageway.

6. The dispenser of claim 3, wherein:

said body includes said head, there being means non-rotatively securing said head onto said tower with said outlet passageway of said head fixedly juxtaposed with said outlet of said helical groove.

7. The dispenser of claim 1, wherein:

said resilient means is constituted by a series of flexible bristles mounted on said outer peripheral sidewall of said tower.

8. The dispenser of claim 1, wherein:

said resilient means is constituted by a covering of flexible bristles mounted on said inner peripheral sidewall of said tubular portion of said sleeve.

* * * * *